United States Patent [19]

Hicks

[11] Patent Number: 5,070,677

[45] Date of Patent: Dec. 10, 1991

[54] AUTOMATED PHOTOGRAPHIC PRINT BAGGER

[76] Inventor: Ray Hicks, 2605 Corunna Rd., Flint, Mich. 48503

[21] Appl. No.: 658,116

[22] Filed: Feb. 20, 1991

[51] Int. Cl.[5] ..... B65B 5/06; B65B 43/30; B65B 63/00

[52] U.S. Cl. ..... 53/435; 53/445; 53/447; 53/459; 53/474; 53/520; 53/155; 53/540; 53/570; 53/386.1

[58] Field of Search ..... 53/435, 445, 447, 459, 53/468, 154, 157, 520, 570, 540, 562, 474, 155, 386.1

[56] References Cited

U.S. PATENT DOCUMENTS

| | | | |
|---|---|---|---|
| 4,073,118 | 2/1978 | Weber et al. | 53/520 X |
| 4,114,349 | 9/1978 | Jensen et al. | 53/520 X |
| 4,115,981 | 9/1978 | Hell et al. | 53/520 X |
| 4,139,978 | 2/1979 | Jensen et al. | 53/520 X |
| 4,139,980 | 2/1979 | Larson et al. | 53/520 |
| 4,154,046 | 5/1979 | Weber et al. | 53/520 X |
| 4,217,743 | 8/1980 | Escales et al. | 53/520 X |
| 4,330,978 | 5/1982 | Willenbring et al. | 53/520 X |
| 4,373,319 | 2/1983 | Pullen et al. | 53/570 X |
| 4,870,807 | 10/1989 | Palamides et al. | 53/540 X |

*Primary Examiner*—Horace M. Culver
*Attorney, Agent, or Firm*—Krass & Young

[57] ABSTRACT

The invention is an apparatus and method for cutting a long roll of photographic prints into individual sheets, and for collating and packaging of those sheets. An automatic print cutter separates a long roll of photographic paper into sheets based on the location of a series of registration marks on the roll. Those photographs which are to be packaged together are collected and are transported by conveyor to a collating station where additional printed materials and packaging may be added to the batch. The batch of photographs and other materials is then conveyed to a packaging station, where the batch is inserted into a flexible bag for further handling. A printer associated with the packaging station prints information regarding the batch on the exterior of the package.

15 Claims, 5 Drawing Sheets

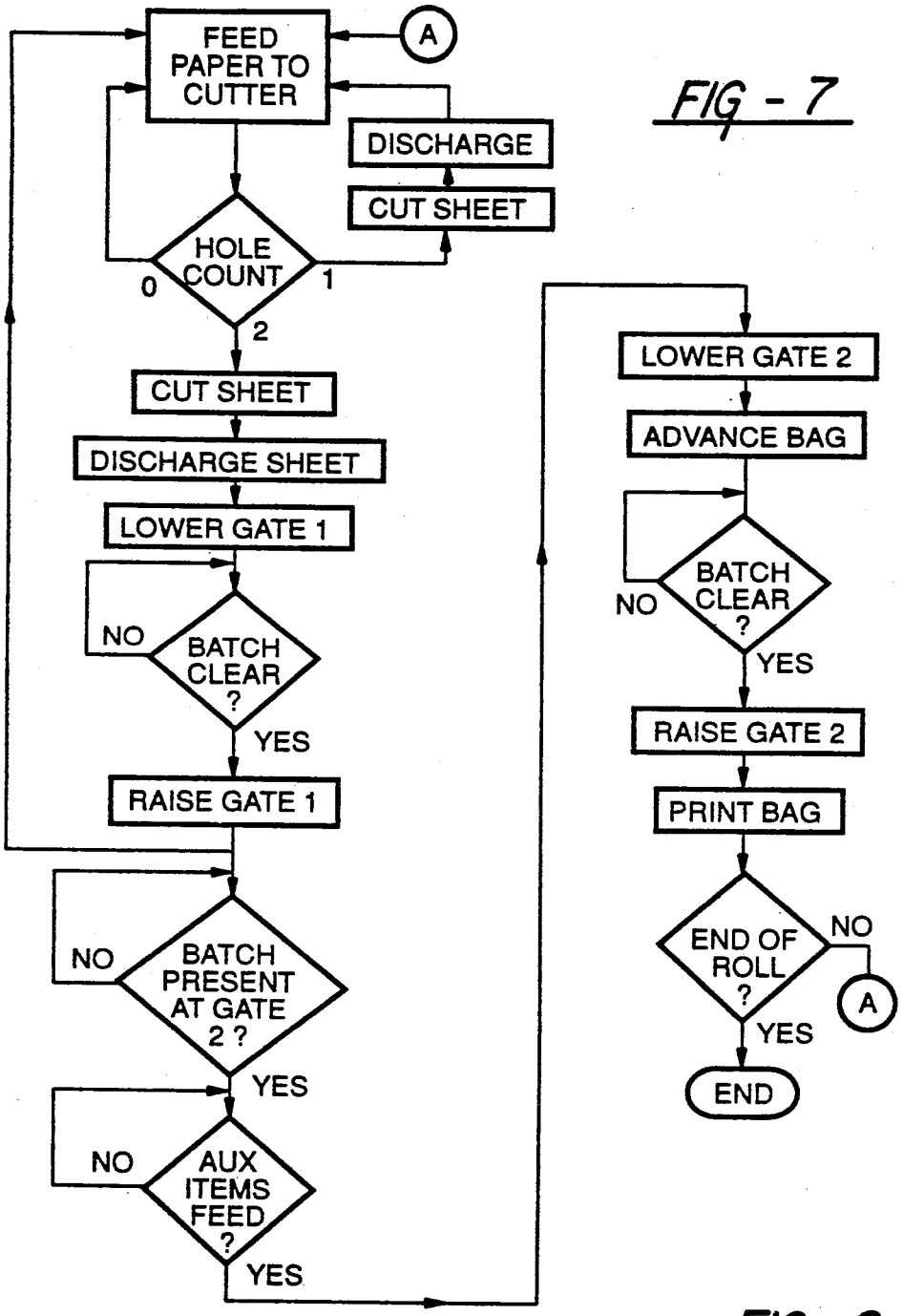
FIG - 7
FIG - 8
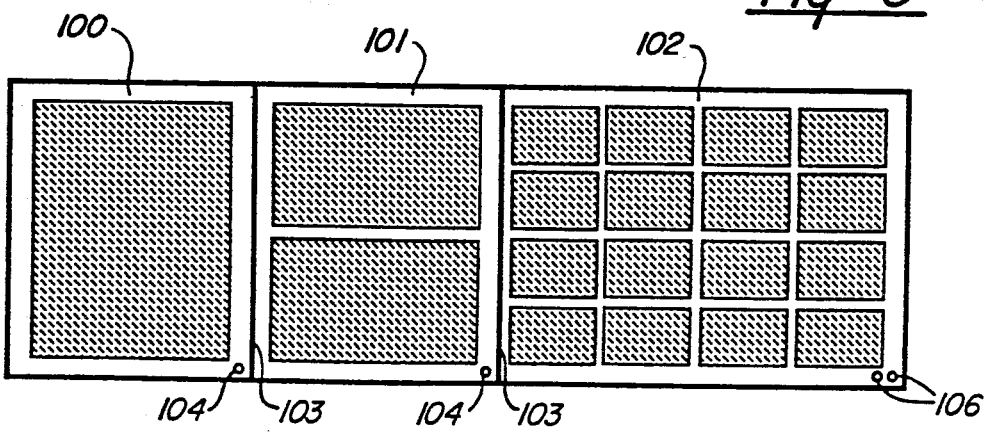

AUTOMATED PHOTOGRAPHIC PRINT BAGGER

FIELD OF THE INVENTION

The invention pertains to machines for cutting and packaging finished photographs, and particular, to machines for separating and collating a collection of individual photographs, and inserting those photographs into a bag for storage and shipment.

BACKGROUND OF THE INVENTION

Commercial photographic processes form the basis for a thriving business concerned with the photographing and rapid processing of large groups of individual photographic subjects. Such commercial activities include the photographing of the individual students at a school, members of a church or the members of an athletic team. Such jobs generate hundreds of individual exposures of photographic subjects, which are typically processed as a series of continuous rolls of photographic film, often spliced together and processed in bulk.

In the typical commercial photographic developing plant, a roll of film is developed, and then spliced with additional rolls of developed film from the same photographer or the same photographic job. By way of example, a commercial photographer may take school photographs at a secondary school consisting of a number of individual student grades, freshmen, sophomore, junior and senior. The photographs of the members of each class may fit on a single roll of film. After processing, all of the rolls of film from a particular secondary school photographic session may be spliced together for processing for the individual photographer undertaking the work.

After the film has been developed and spliced into this type of long roll format, it is subject to a preliminary visual inspection, and then transported to an automated photographic printer. The automated photographic printer sequentially exposes each photographic negative frame through a series of lenses, generating a corresponding series of exposures on sensitized photographic film. This film is then subject to a chemical developing process, producing a corresponding long roll of developed photographs.

Each subject in a typical photographic sitting such as the one above described is typically permitted to make an order selection, based on a series of choices presented by the photographer. For example, the student may elect to receive a single 8½"×11" photograph, a collection of 5"×7" photographs, a larger collection of wallet-size photographs, or some combination of the foregoing. Typically, the automated photographic printer is provided this order information through a series of machine instructions, or by instructions provided manually to the printer by an operator. In either event, following the exposure and development of the long roll of negatives, the commercial photographic plant produces a long roll of developed photographs, which contain a sequentially organized order for each student. The content of each order, however, differs for each subject. In the past, separation of the long roll of developed photographs into individual subjects orders has been done manually. In this process, a human operator unrolls the long roll of developed photographs, and visually inspects each section of the roll. The operator identifies the photographic subjects on successive sections of the long roll, and manually cuts the photographic paper into individual sheets. The individual subject's photographs are then manually collated and placed into an envelope for storage and shipment.

Recently, automated print cutters have become available which simplify and accelerate the process of separating the individual photographic orders from the long roll of developed photographic prints. To take advantage of this new equipment, the automated photographic printer is provided with a punch mechanism; Each exposure of photographs for an individual subject is separated from the adjoining exposures by a single hole punched in the margin of the photographic paper between the two exposures. In this fashion, an individual 8½"×11" exposure for a subject is made in the photographic printer, the photographic paper is advanced, and the same negative is exposed through a lens deck carrying multiple lenses onto the next section of photographic paper, resulting in multiple exposures of the photographic subject on that section. When the individual subject's photographic order has been completely exposed, the automated photographic printer then places a pair of closely spaced punched holes on the photographic paper margin. When the photographic paper so punched is presented to the automatic paper cutter, the paper cutter recognizes the single punches as separating the individual pages of a subject's order, and recognizes the double punches as separating the pages of one subject's order from the pages of the following subject's order Nevertheless, the separation and bagging of the individual subject's orders has remained a manual operation. This is a tedious job, and subject to substantial human error. In addition, it is frequently necessary to insert additional materials into the envelope along with the photographic exposures, for example, order forms for reorder, advertising brochures, stiffeners and picture frames. These additional requirements tend to slow the process further.

The present invention provides a mechanism for accomplishing these tasks in an economical and expeditious fashion.

SUMMARY OF THE INVENTION

The present invention features three major operative substations cooperating with a common conveyor system for transporting, cutting and bagging individual photographs. The system may also include one or more additional stations for collating the individual photographs with additional paper materials, such as re-order forms, prior to the bagging operation.

The conveyor system is the physical platform to which each of the subassemblies is mounted. In the most basic of configurations, a long roll of photographs is removably mounted to a feed spool station, which is, in turn, part of a photographic print cutter of a type commercially available. An example of such print cutter is the Brooke BP1200. This cutter is equipped with conventional pneumatic or optical sensors, capable of sensing the presence of marks or punches placed on the edge of the photographic print roll. These marks define a desired cut point on the long roll of prints. A shear cutting mechanism mounted on the print cutter separates the long roll into individual sheets of photographs, and cutter discharge rollers associated with the cutter eject the cut sheet from the cutter to the following collating substation.

The collating substation collects a batch of photographic prints for further handling. In the usual course of events, several individual sheets of photographs are collected at the collating substation. When the desired batch has been collected, the conveyor system delivers the batch to the bagger substation through the selective operation of a gate.

At the bagger substation, a continuous strip of print bags, separated by perforations, is transported across the conveyor at right angles to the direction of travel of the batch. A plurality of blowers is mounted above and below the bag, creating the necessary suction to hold open each bag as it is presented to the conveyor. When the bag is so positioned and opened, the gate above referenced opens, allowing the batch to be transported into the open bag. The bag is then further transported to a printer head, where printed information regarding the batch may be printed on the exterior of the bag. The filled bags are then allowed to accumulate for further handling, e.g., bursting and sorting.

In addition to the above substations, additional substations may be attached to the conveyor for the purpose of adding additional materials to each batch of photographs. Typically, processed batches of photographs are packaged together with re-order forms, promotional materials, cardboard frames, cardboard stiffeners or some combination of the foregoing. These additional substations may be positioned immediately adjacent to the feed end of the conveyor system, or at several points along the conveyor path.

DESCRIPTION OF THE DRAWINGS

The above and additional objects of the present invention are best understood by reference to the detailed description which follows, and by reference to the attached drawings, in which:

FIG. 7 is a block diagram showing the cycle of machine operations of the invention.

FIG. 8 is a simplified drawing of a section of a roll of photographic paper, showing the orientation of exposures thereon.

DESCRIPTION OF THE PREFERRED EMBODIMENT

Figure 1:
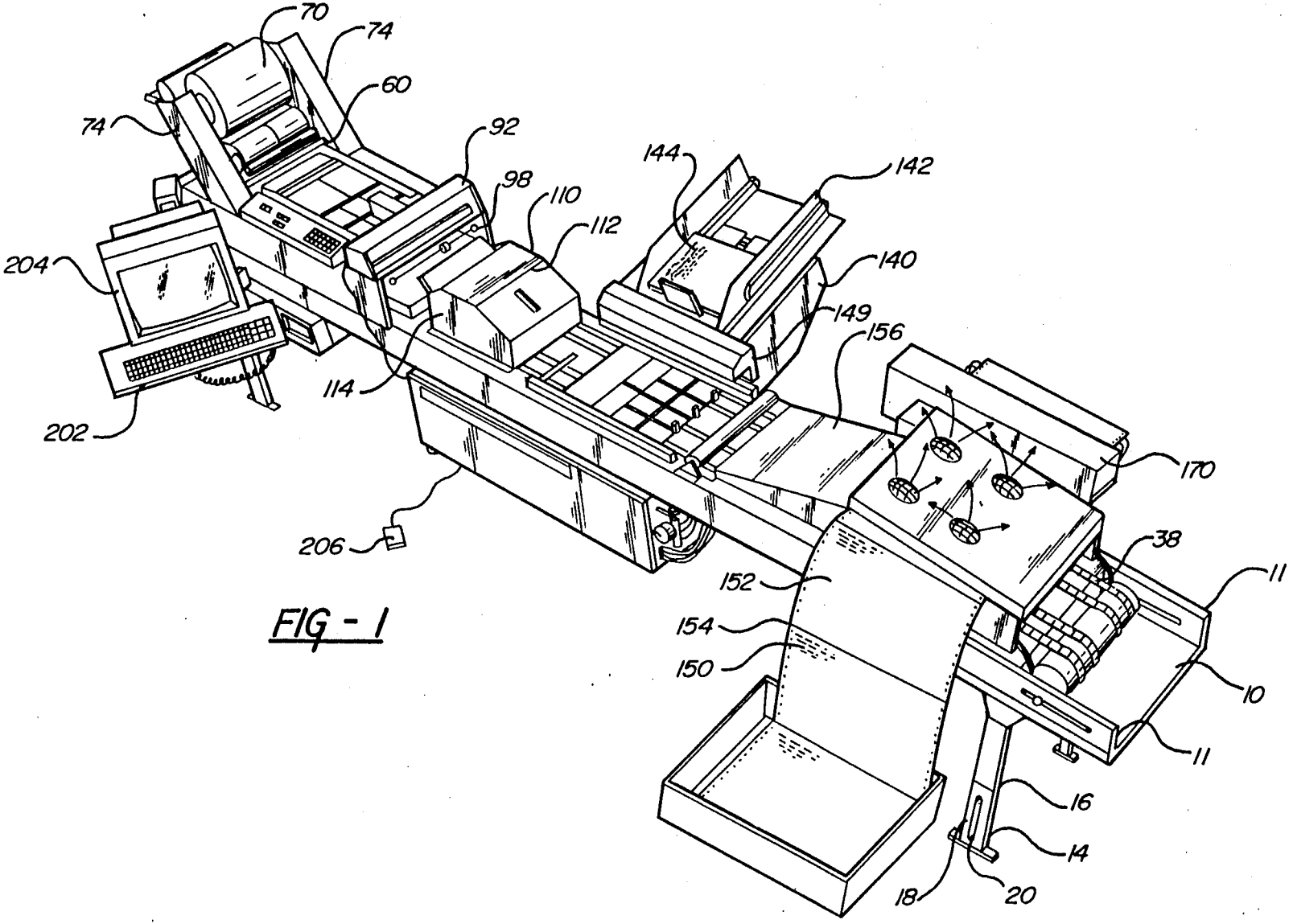
FIG. 1 is a perspective view of the invention
Figure 2:
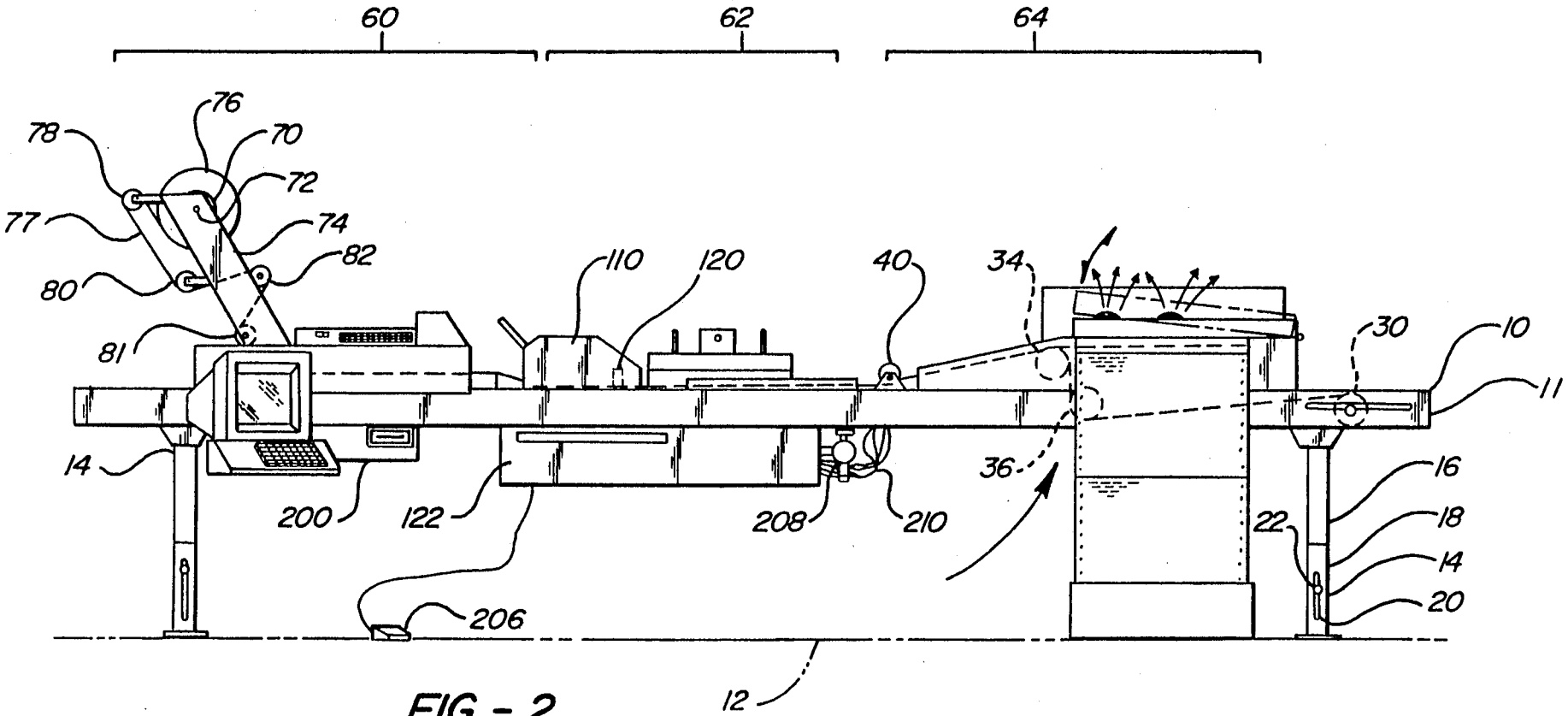
FIG. 2 is a simplified side view of the conveyor, showing the movement of the materials therethrough.
Figure 3:
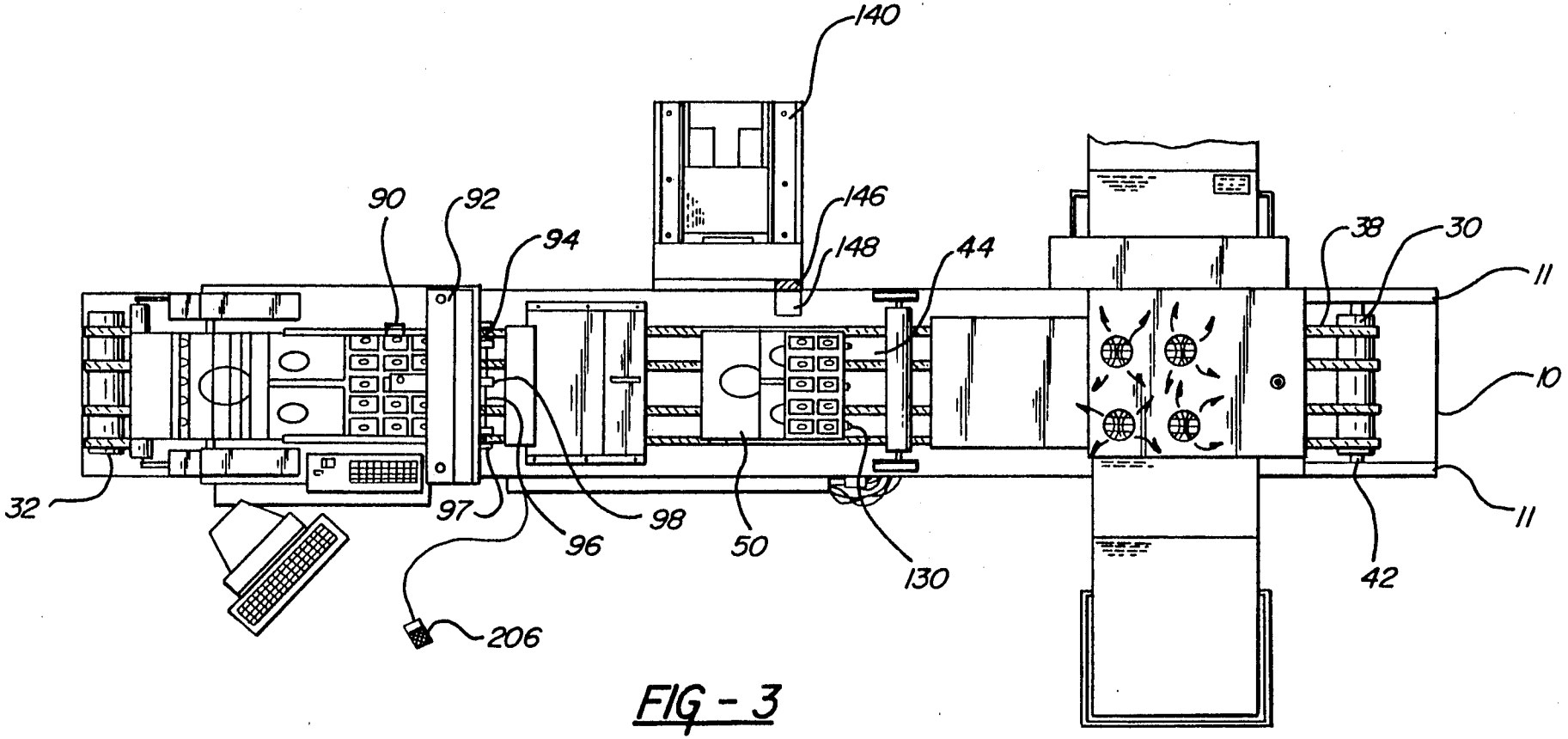
FIG. 3 is a top view of the invention, showing the relationship of the various substations to the conveyor.

The print cutter/bagger assembly is a collection of elements mounted on, or secured adjacent to, a variable speed conveyor system. With reference to FIGS. 1 through 3, a conveyor frame 10 is mounted at a desired height above a floor surface 12 by a plurality of adjustable legs 14. Each leg is equipped with adjusting means which facilitate vertical adjustment of the conveyor frame in relation to the floor on which the system rests. These legs 12 also allow selective leveling and positioning of the conveyor frame in relation to a human operator, and in relation to other photographic print handling equipment which may be cooperating with the cutter/-bagger. In the preferred embodiment, the leg adjustment is made by virtue of a telescoping inner leg member 16 and outer leg member 18 combination. Each such leg member is provided with a slotted adjusting hole 20, through which is fitted a removable bolt 22 and nut (not shown). Each inner leg member 16 is fixed, in conventional fashion, to the conveyor frame 10. Each outer leg member 18 is free to slide over such inner leg member 16 in a telescoping fashion. The removable bolt 22 is inserted through both inner and outer leg members so that the desired overall length of the combined inner and outer leg has been achieved and tightened in position with its associated nut, thereby securing the inner and outer legs in juxtaposition.

The conveyor frame 10 is further comprised of two parallel frame rails 11 which support a series of belt rollers. At least one such roller 30 is driven by drive means, which preferably is an electric motor capable of variable speed operation. A guide roller 32 is positioned at the end of said frame rails 11 opposing said drive roller 30. Third 34 and fourth 36 positioning rollers selectively elevate a portion of the conveyor belts 38 at the bagging station, and fifth tensioning roller 40 repositions and provides tension to the belts 38. Each non-driven positioning and tensioning roller is affixed to the conveyor frame sides 11 by bearing means 42 to minimize friction between each roller and said frame rails 11.

Mounted between the frame rails, at the uppermost edge thereof, is a support plate 44. This plate defines a substantially planar horizontal surface over which the conveyor belts 38 travel, and which supports the belts 38 and the materials transported thereon. In the preferred embodiment, the upper surfaces of the plate is polished smooth, thereby minimizing the friction between the conveyor belts 38 and the plate 44.

A plurality of parallel continuous flexible and stretchable loop conveyor belts 38 are spaced apart and surround the rollers as shown in FIGS. 1 and 2. The rollers define the path of travel of said belts 30 from the print cutter 60 to the collating substation 62 to the bagging substation 64. Between the feed end of the conveyor at roller 32 and the tensioning roller 40, the belts 38 travel in an essentially horizontal plane as viewed from the side and depicted in FIG. 2. After first tensioning roller 40, the belts may be selectively elevated by third positioning roller 34. Thereafter, the path of travel of the belts is routed sharply downward by fourth positioning roller 36. As can be seen from the drawing, the path of travel of the conveyor belts between roller 36 and drive roller 30 is again essentially horizontal. The belt loops continue under the conveyor frame 10, where they are guided at the opposing end of the frame by guide roller 32.

With reference to FIG. 2, a continuous roll 76 of photographic prints is spooled at roll spool 70. Roll spool 70 is supported above the print cutter station 6 on a support shaft 72 which is positioned over the cutter by opposed support arms 74. The free end of the continuous roll 76 so supported is threaded around decurling roller 78 which imparts a reverse curl to the photographic print paper. Inasmuch as the roll of photographic print paper is typically wet processed, and subject to heat drying, the roll of photographic paper tends to acquire a "set" in the form of a curl which corresponds to the curvature of the long roll. The application of a reverse curl is, accordingly, a desirable production step prior to cutting. A pair of guide rollers 80 and tensioning roller 82 directs the photographic paper 77 through the cutter substation 60, and provides suitable tensioning thereof.

The operation of the print cutter mechanism is regulated by a series of registration marks applied to the edge of the photographic paper at pre-determined positions. In the preferred embodiment, a batch of photographic exposures is defined as a continuous succession of exposures on the long roll of photographic paper. With reference to FIG. 8, the same subject appears on three distinct frames 100–102 of identical size on the long roll. The first frame 100 contains a single 8½"×11" photographic image, the second frame 101 contains two 5"×7" images, while the third frame 102 carries sixteen 1½"×2¼" wallet-sized images. This batch represents a typical customer order for photographs from a "school pictures" sitting. These photographs are cut into three separate sheets along cut lines 103, collated and bagged according to the following description.

Prior to mounting the long roll on the cutter assembly, the long roll of prints is processed at an inspection station, at which time an operator views the prints, and places a single punch 104 in the edge of the film at each point where a cut is required. Further, after the final print in each batch, the operator places a double punch 106 on the paper edge. In the alternative, the punches may be placed automatically during the printing operation. Opaque registration marks may be substituted for punches in some applications and commercial photo processing environments.

With reference again to FIGS. 1–3, the paper so marked, when passed through the cutter mechanism of the preferred embodiment, may be easily separated, without operator intervention, by reference to said marks 104 and 106. As the paper 77 passes through the cutter substation 60, it is gripped by one or more pressure rollers 81, which serve to positively advance the paper in proximity to the mark sensor 90 and the cutting knife assembly 92. The sensor 90 detects the presence of each mark on the paper edge. When a single mark is detected, the sensor transmits a "cut" command to the cutting knife assembly 92. The knife assembly cuts a section of the paper at a pre-determined point and a traction roller moves the print away from the cutting knife assembly 92. Here, a discharge roller 94 simultaneously grips, propels and creases the cut section. To accomplish these steps, the discharge roller assembly comprises a roller shaft 96, two outboard rollers 97 and a center creasing roller 98. The outboard rollers 97, located near the ends of the roller shaft 96, serve to center the cut sheet along the axis of motion of the conveyor belts 38. The center creasing roller 98 bends the center of the cut sheet upward slightly, counteracting the curl of the sheet, and facilitating the discharge of the sheet into the collating substation 62. In this fashion, the separated sheets forming a batch are sequentially discharged from the cutting mechanism to the collating substation.

The collating substation 62 includes a cut sheet guide cover 110, preferably formed of sheet metal. The guide cover 10 is, in cross section, in the form of an inverted "U", having a top 112 and two opposed sides 114. The guide cover is pivotably secured, at one end, to the conveyor frame, thereby allowing the cover 110 to be swung upward and toward the bagging substation 64 to allow access to the conveyor surface below said guide cover 110.

A plurality of retractable gate elements 120 protrude through the conveyor support plate 44 at a point proximate the pivoting end of said guide cover 110. In the preferred embodiment, three first gate elements are mounted to a retraction/extension mechanism 122 suspended below the conveyor frame 10 approximately midway between the frame ends. The gate elements 120 protrude above the surface of the support plate 44 a suitable distance to prevent movement of the cut sheets along the conveyor 38 until the desired batch has been collated. Throughout the process above described, the individual conveyor belts 38 remain in motion. The cut sheets are normally transported along the conveyor surface by the movement of said belts. However, the extension of the described gates 120 serves to block movement of the cut sheets with the conveyor belt 38, which slides harmlessly beneath the bottom most cut sheet during the collation process. When the mark sensor 90 detects an "end-of-batch" edge marking, the cutter/bagger control system allows the last cut sheet of the batch to be ejected to the collating substation 62, and immediately thereafter signals the gates 120 to be momentarily retracted to a position below the surface of the conveyor support plate 44, thereby allowing the batch of cut sheets 50 to be propelled along the conveyor path. In the preferred embodiment, the first gate elements return to the extended position as soon as the batch 50 has exited the collating station, thereby preparing said station to receive prints from the following batch.

A second set of gates 130 is disposed on the conveyor, between the first gate elements 120 and the bagging substation 64. These gates 130 allow the installation of an auxiliary product feed device 140 in cooperation with the conveyor system. In the depicted embodiment of FIG. 1, such auxiliary feed device 140 may take the form of an inclined bin 142 containing additional materials 144 to be packaged with each batch 50 of cut sheet photographs. Among the materials which may be so added to the batch are picture frames, cardboard packaging stiffeners, advertising brochures and re-order forms. In one preferred embodiment of the invention, a photocell 146 on said feed device is associated with a light source 148 mounted below the conveyor support plate 44 in proximity to said second gate 130. The auxiliary feed device 140 incorporates product ejection means 149, typically in the form of a gripper roller which engages one piece of such additional materials 144. As the batch 50 of cut sheets is conveyed from the first gate element 120 position to the second gate element 130 position, the batch 50 of cut sheets interrupts said light source 148. The interruption of said light source 140 is detected by the photocell 146, which signals the ejection means to discharge the additional materials 144 from the bin 142 and onto the batched cut sheets held in position by said second gate 130. Upon ejection of said materials 144, the feed device 140 transmits an end-of-cycle signal to the cutter/bagger control circuitry, which causes the second gate 130 to retack to a position below the surface of the conveyor support plate 44, thereby allowing the batch 50 of cut sheets and additional materials to be discharged to the bagging substation 64. In practice, more than one auxiliary feed device 140 may abut the conveyor system, allow several diverse auxiliary materials to be discharged to the batched materials awaiting bagging.

Such auxiliary feed means may be positioned at the end of the conveyor adjacent to the cutter substation 60. Materials fed to the conveyor system pass below the cutter mechanism 92 into the collating substation 62, where they are held by said first gates 120 until the batch 50 of cut sheets has been completely fed into the collating substation 120. Again, operation of said auxiliary feed means is sequential, and regulated by a control system to insure discharge of a predetermined number of auxiliary material items for each batch cycle.

Figure 4:
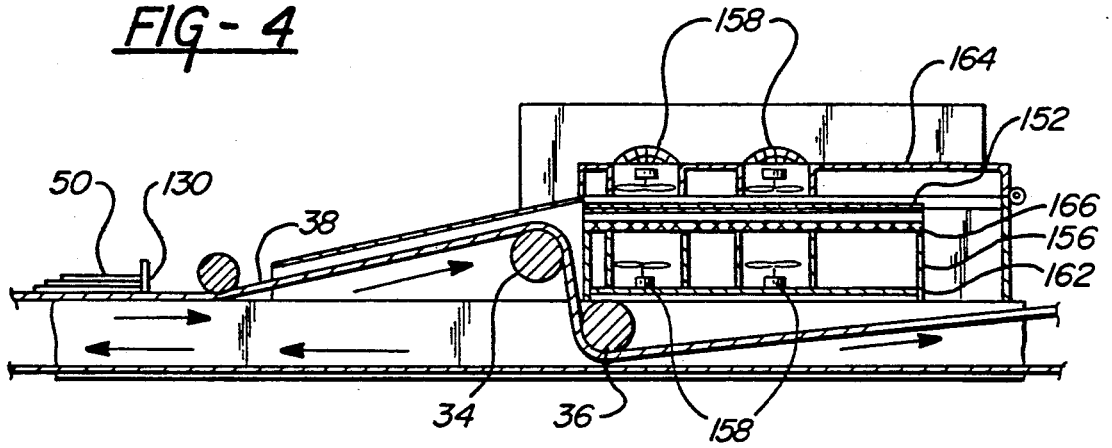
FIGS. 4, 5, and 6 are detailed views of the operation of the print bagging substation.
Figure 5:
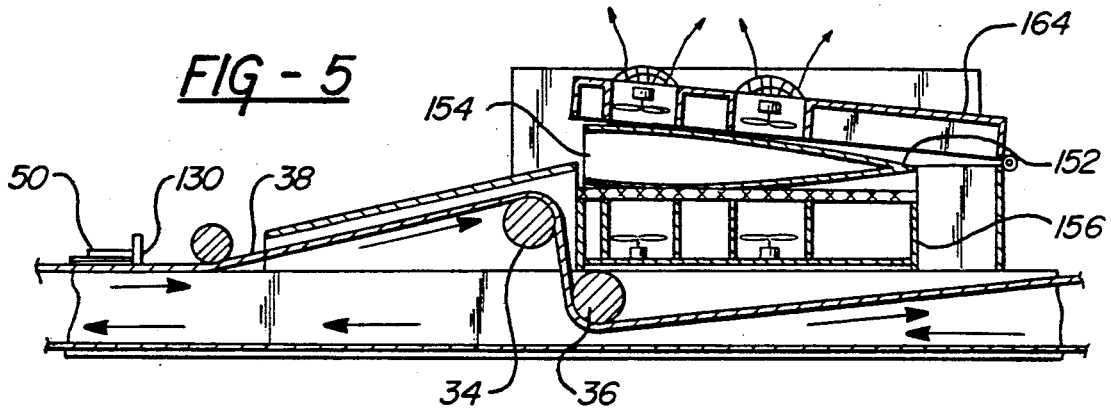

As shown in FIG. 1, once the complete batch 50 of cut sheets and auxiliary materials has passed the second gates, the batch 50 is transported by the conveyor to the bagging substation 64. Here, a continuous strip 150 of flexible bags 152, separated by perforations 154, is transported across and above the conveyor path. Pivotably mounted to the conveyor support plate is a batch top guide 156, which contains the upper surface of the batch 50 and prevents individual elements from separating from the batch. The top guide 156 also serves to direct the batch toward the opening in the flexible bags 152. Because the bagging substation is mounted above the horizontal path of the conveyor belt, a series of positioning rollers cause the conveyor belt to deviate upward, directing the batched materials toward the openable end of the bag below described, with reference to FIGS. 4 through 6.

The continuous strip of print bags 150 is disposed on tractor feed means which transport the bags 152 across the conveyor frame, disposed with the bag opening facing the collating station. Each individual bag 152 is separatable from each adjoining bag by perforations. In the usual embodiment, the bags are of paper construction, and bear the pre-printed commercial logo of a photographer, photo studio or the like. The bags are typically constructed of two sheets of paper or similar thin material, and are sealed at three sides, with one side left as an opening 154 into which the batch 50 may be inserted. The bagging substation 64 base 156 contains a plurality of electrically-operable fans 158 which draw air from the upper surface 160 of the base, and discharge air through the lower surface of said base 162. The bagging substation cover 164 is hinged to the base, allowing the cover to swing upwards from the base, facilitating loading of the continuous strip of bags. The cover 164 is likewise equipped with a plurality of fans 158, drawing air from the lower surface of the cover and discharging air through the upper surface of the cover. In this manner, when the bagging station is in the closed (or lowered) position, a gap is formed between the upper surface of the base and the lower surface of the cover. The operation of the fans serves to create an area of low pressure on both sides of the bags 152 transported through the bagger substation, which forces the opening of each bag as it is transported through the bagger.

The movement of the bags is coordinated, by machine controls, with the operation of the second gates. In the preferred embodiment, the bagging substation 64 is located proximate the conveyor positioning rollers 34 and 36 to accept the batched materials 50 moving along the conveyor belts 38. As the second gate 130 begins to open, the bagging substation transports an empty bag 152 into position between the bagging substation base 156 and cover 164. The action of the bagging station fans 158 forces the bag 152 to open. As the second gates 130 retract fully, the batched material 50 is directed by the conveyor into the open bag. Simultaneously, a print head mechanism 70 as shown in FIG. 1, attached to the bagging substation prints desired data on the exterior of the bag 152, typically to identify the subject, the photographer, date, job number and the like. Thereafter, the bag 152 is transported from the bagger substation, and the entire cutting, collating and bagging operation begins again.

Figure 6:
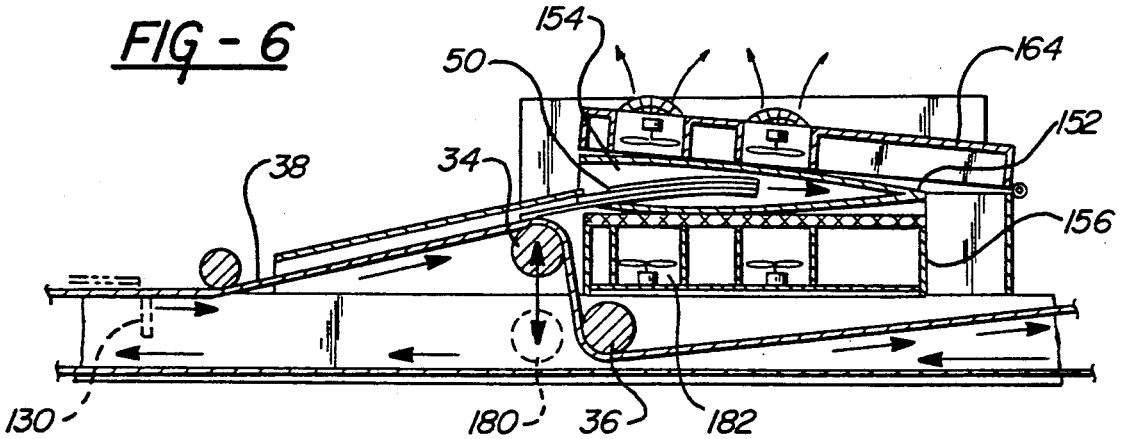

Positioning rollers 34 and 36 are selectively repositionable, in the preferred embodiment, to the positions shown in phantom in FIG. 6, 180 and 182. In this alternate position, the conveyor 38 follows a path which carries the batch 50 under the bagging substation 64, thereby transporting the batched materials along the conveyor, for discharge, if desired, at drive roller 30 end of conveyor frame 10. In this fashion, the print cutter/bagger may be instructed to pass a particular batch of prints by the bagging substation, for further handling, or to be discarded.

All operations of the invention are preferably coordinated by the operation of a computer 200 and a machine control system in software. A commercially available microcomputer 200 is electrically connected to the conveyor motor and substations 60, 62 and 64 to monitor and control cutting, transport, collating, bagging, printing and discharge operations. Data regarding each cutting and bagging job is transmitted to the microcomputer via transportable media, such as removable disks, or via computer network data lines. Such data may include comprehensive information regarding photographic exposures, for example, subjects name, address, institution, photographic sitting date, composition of order and related information. Likewise the data may include detailed photographic processing parameters, such as color correction variables. This information is useful in many steps of the cutting and bagging process. Inasmuch as the contents of a particular subject's order is accessible by the computer, the cutter/bagger can easily be programmed to insert, utilizing an auxiliary feed device, the correct number and size of photo frames with each specific package. Similarly, subjects who order only one print may receive a re-order form as part of the package, whereas subjects receiving a full complement of photographs may be provided a discount coupon for future sittings or additional prints. All or part of this information may be printed on the bag exterior. Additionally, the completion of the cutting and bagging operation can be sensed by the computer and recorded to the computer data record pertaining to each subject.

The mechanical, electrical and pneumatic controls which determine machine operation can best be understood with reference to FIG. 7. To start the machine cycle, a long roll of photographic paper is fed from the spool to the paper cutter mechanism. The detector at the paper cutter is preferably programmed to detect one of three states: no hole punched, one hole punched or two holes punched. If the detector determines that there is no hole punched in the paper margin, the paper feed continues to advance. In the event the detector determines the presence of a single hole in the margin, instructions are sent to the cutter to stop the feed process cut and discharge a sheet. In the event that the detector determines the presence of two holes in the margin, the cutter is instructed to cut and discharge the present sheet, and thereafter, to lower gate 1.

A photocell detector on the surface of the conveyor proximate gate determines the presence or absence of a batch of cut sheets at the collating station. As soon as the batch has cleared the collating station, the photocell sends a signal to the conveyor controller to again raise gate 1. At the same time, the cutter feed and cut cycle is restarted.

A photocell in the surface of the conveyor at gate 2 senses the presence or absence of a batch of materials on the conveyor at that gate. The controls sequence loops until a batch is presented to gate 2. When a batch of materials is detected at gate 2, the controls program signals the optional auxiliary item feed bin to eject the auxiliary item to the batch at gate 2. In the preferred embodiment, the ejection of auxiliary materials is sensed by a suitable photocell or mechanical switch at the auxiliary item feed bin. When the control program has been advised of the discharge of the auxiliary item to the batch at gate 2, the conveyor control program lowers gate 2 and simultaneously advances the bag at the bagging substation. As soon as the photocell at gate 2 ascertains that the batch has been cleared and transported to the bag, the conveyor controller raises gate 2 and instructs the printer to print appropriate information on the bag.

This operation is a continuous loop, capable of operating in stages. For example, the preferred embodiment, once a batch has been cleared from gate the conveyor controller instructs the paper cutter and paper cutter feed mechanism to continue the cutting operation for the following batch. In this fashion, a continuous series of batches is moved progressively through the sub-stations of the conveyor, resulting in increased speed and efficiency in processing.

In addition to the machine controls above outlined, which are designed to operate without human intervention, the cutter/bagger and each of its substations may be controlled by operator entry to computer keypad 202. Feedback to the operator, help screens and menus for machine operation are displayable on computer monitor 204. In addition, foot switch 206 may be used to control specific machine cycles under direct operator control. Pneumatic manifold 208 provides selected air pressures to various components of the cutter/bagger through air lines 210.

Having described my invention, numerous modifications and improvements will be apparent to those with skill in the art, without departing from the essence of my invention, which I claim as follows:

I claim:

1. A device for separating a continuous roll of photographic print paper into individual sheets and packaging said sheets, comprising:

a. A conveyor;
b. A feed spool supporting the continuous roll on said conveyor;
c. Paper cutting means;
d. Guide roller means for directing one end of said continuous roll from said spool to said cutting means;
e. Means for detecting the presence of registration marks on said roll;
f. First control means for operating said cutting means in response to said detection means, thereby separating a section of said roll from said roll;
g. First transport means for propelling said section onto said conveyor;
h. Means for substantially continuously operating said conveyor;
i. Second transport means for sequentially transporting individual bags into proximity with said conveyor;
j. Retaining means for controlling the movement of said section along said conveyor between said first transport means and said second transport means; and
k. Said conveyor being further adapted to divert aid section into one of each said bags.

2. The invention of claim 1, which further comprises:

a. At least one product delivery bin oriented in proximity to said conveyor;
b. Product delivery means for propelling a product from aid bin to said conveyor;
c. Product sensing means associated with said conveyor; and
d. Control mans associated with said product sensing means for selectively operating said product delivery means in response to said product sensing means.

3. The invention of claim 1, which further comprises printing means affixed to said second transport means.

4. The invention of claim 2, which further comprises printing means affixed to said second transport means.

5. The method of separating individual sheets of photographic paper from a long roll of photographic paper, and for selectively packaging said sheets which comprises:

a. Transporting the free end of said roll through a paper cutting apparatus;
b. Detecting the presence of registration marks on said roll, thereby generating a control signal;
c. Operating said paper cutting apparatus in response to said control signal to separate said long roll into a plurality of individual sheets;
d. Providing a conveyor assembly;
e. Operating said conveyor assembly substantially continuously;
f. Transporting at least one of said plurality of individual sheets along said conveyor assembly to a collection station;
g. Retaining said at least one sheet at said collection station;
h. Selectively releasing said at least one sheet from aid collection station;
i. Transporting said released at lead one sheet along said conveyor assembly to a collating station;
j. Retaining said at least one sheet at said collating station;
k. Providing an open package in proximity to said conveyor assembly;
l. Releasing said at least one sheet from said collating station;
m. Conveying said at least one sheet along said conveyor assembly into said package; and
n. Transporting said package away from proximity to said collating station.

6. The invention of claim 5, which further comprises:

a. Selectively transporting ancillary product to said collating station; and
b. Sensing the transport of said ancillary product to said collating station.

7. The invention claim 5, which further comprises printing information regarding said at least one said sheets on said package.

8. The invention of claim 6, which further comprises printing information regarding said at least one said sheets on said package.

9. The invention of claim 5, wherein the step of providing an open package in proximity to said conveyor assembly further comprises the steps of transporting a closed package into the proximity of said conveyor assembly and thereafter opening said package.

10. The invention of claim 1, which further comprises a guide means adapted to cooperate with said conveyor to divert said section into one of each said bags.

11. The invention of claim 1, which further includes means for articulating aid conveyor between positions proximate and apart from said individual bags so as to respectively select between diverting said section into said bag or allowing said section to be transported further along said conveyor.

12. The invention of claim 5, wherein said step of providing a conveyor assembly further includes the step of providing a conveyor assembly having means for articulating at leas tone conveyor belt between positions proximate and apart from said individual bag so as to receptively select between depositing said sheets in said individual bag or allowing said sheets to be transported further along said conveyor assembly.

13. A device for separating a continuous roll of photographic print paper into individual sheets and packaging said sheets, comprising:

a conveyor assembly adapted to cycle at least one conveyor belt substantially continuously;

means for positioning an individual bag from a plurality of consecutively attached bags across a downstream portion of said conveyor assembly so that the opening of said individual bag faces an upstream potion of said conveyor assembly;

means for controllably severing sections of the roll of photographic paper into individual sheets and delivering sheets to the upstream portion of said conveyor assembly;

means or gathering a plurality of said sheets at a given position along said conveyor assembly while said at least one conveyor belt cycles therebelow;

means for releasing said plurality of said sheets to allow said conveyor assembly to deliver said plurality of sheets to said individual bag.

14. The invention of claim 13, wherein said conveyor assembly further includes means for articulating said at least one conveyor belt between positions proximate and apart from said individual bag so as to respectively select between depositing said sheets in said individual bag or allowing said sheets to be transported further along aid conveyor assembly.

15. The invention of claim 13, which further includes means for transporting ancillary product to an upstream potion of said conveyor assembly.

* * * * *

UNITED STATES PATENT AND TRADEMARK OFFICE

CERTIFICATE OF CORRECTION

PATENT NO. : 5,070,677

DATED : December 10, 1991

INVENTOR(S) : Ray Hicks

It is certified that error appears in the above-identified patent and that said Letters Patent is hereby corrected as shown below:

Column 2, line 8, change "mechanism;" to --mechanism.--;

Column 8, line 57, change "gate determines" to --gate 1 determines--;

Column 9, line 15, change "gate the" to --gate 1, the--;

Column 9, line 64, change "aid" to --said--;

Column 10, line 2, change "aid" to --said--;

Column 10, line 33, change "aid" to --said--;

Column 10, line 34, change "lead" to --least--;

Column 10, line 51, change "invention claim" to --invention of claim--;

Column 10, line 66, change "aid" to --said--;

Column 11, line 6, change "leas tone" to --least one--;

Column 11, line 8, change "receptively" to --respectively--;

UNITED STATES PATENT AND TRADEMARK OFFICE

CERTIFICATE OF CORRECTION

PATENT NO. : 5,070,677

DATED : December 10, 1991

INVENTOR(S) : Ray Hicks

It is certified that error appears in the above-identified patent and that said Letters Patent is hereby corrected as shown below:

Column 11, line 21, change "potion" to --portion--;

Column 12, line 5, change "or" to --for--;

Column 12, line 17, change "aid" to --said--;

Column 12, line 20, change "potion" to --portion--.

Signed and Sealed this

Eighteenth Day of May, 1993

*Attest:*

Michael K. Kirk

MICHAEL K. KIRK

*Attesting Officer*

*Acting Commissioner of Patents and Trademarks*